US005226504A

United States Patent [19]

Bumbera

[11] Patent Number: 5,226,504

[45] Date of Patent: Jul. 13, 1993

[54] SELF ADJUSTING LADDER STABILIZER

[76] Inventor: Ed J. Bumbera, 4621 Dennis Way, Las Vegas, Nev. 89121

[21] Appl. No.: 992,804

[22] Filed: Dec. 18, 1992

[51] Int. Cl.[5] ..... E06C 7/00
[52] U.S. Cl. ..... 182/172; 182/107
[58] Field of Search ..... 182/172, 107, 112, 200

[56] References Cited

U.S. PATENT DOCUMENTS 1,735,992 11/1929 Bode ..... 182/172 X
2,327,317 8/1943 Randall ..... 182/107 X
3,786,900 1/1974 Olsen ..... 182/172

FOREIGN PATENT DOCUMENTS 8302796 8/1983 World Int. Prop. O. ..... 182/107

*Primary Examiner*—Alvin C. Chin-Shue

[57] ABSTRACT

A ladder stabilizer is disclosed which is an add-on to an existing step-ladder which requires no alteration or modifications of the step-ladder. The apparatus consists of a V-shaped member supporting L-shaped telescopic legs, the V-shaped member being attached to two parallel cross members which join the front and back legs of the ladder together and when the ladder is rocked in a lateral motion the L-shaped legs fall inward until they are in stable contact with the ground surface, thus being self-adjusting.

11 Claims, 3 Drawing Sheets

SELF ADJUSTING LADDER STABILIZER

FIELD OF THE INVENTION

This invention relates to ladders and more particularly to an apparatus to stabilize a step ladder.

BACKGROUND OF THE INVENTION

Ladders are well-known and useful implements. There are various types of ladders, including step ladders and extension ladders. While ladders are generally useful and convenient, they do suffer the disadvantage of being somewhat unstable, tending to tip laterally if a lateral force is applied thereto, particularly when the force is applied above the center of gravity of the ladder. As used herein, the term "lateral" refers to a direction or motion which is substantially parallel to the rungs or steps of a ladder. For example, a lateral adjustment would be one which is substantially parallel to the rungs or steps of the ladder. Also, ladders can possess a lack of transverse stability under certain circumstances. The term "transverse" herein refers to a direction which is substantially perpendicular to the rungs or steps of a ladder.

The present invention is directed to a method and apparatus for stabilizing a ladder, to minimize the unstableness which is characteristic of most commercial and non-commercial ladders.

Preferably, a ladder stabilizer will accommodate an uneven ground surface and will also allow an individual using a ladder to lean in various directions and move about without causing the ladder to sway or slip. It is also preferable that a ladder stabilizer be fully adjustable to accommodate other conditions such as the presence of a wall, tree, etc., while still rigidly and safely bracing the ladder.

Prior art ladder stabilizers generally do not provide sufficient adjustability and stability and none of the prior art teaches the "self-adjusting" feature of the present invention.

Also, the prior art teaches a number of embodiments which require modification of the ladder such as U.S. patent No. 4,964,488 to Stewart which requires that braces be attached to the ladder and are not self-adjusting. The U.S. patent No. 4,926,968 also teaches braces which must be attached by boring holes in the ladder to mate with the braces and are not self-adjusting. Again, U.S. patent No. 4,872,529 teaches braces which while being telescopic must be attached to a modified ladder and is not self-adjusting.

The ladder stabilizer of the present invention is directed to the shortcomings of the prior art ladder stabilizers. In particular, it provides removably attachable means which requires no alteration of the ladder and is self-adjusting when the ladder is "rocked" laterally.

SUMMARY OF THE INVENTION

It is therefore a primary object to provide a ladder stabilizer which is adaptable to a step-ladder which requires no modifications of the ladder.

Another object is provide a ladder stabilizer which may be installed on substantially any size step-ladder by using simple hardware such as nuts or wing nuts.

Another important object is to provide legs which are self-adjusting when the ladder is rocked in a lateral motion.

Still another important object is to provide a ladder stabilizer which is fabricated from conventional square tubing stock and requires no expensive tooling thus making the apparatus inexpensive to manufacture.

Other objects and advantages will become obvious when taken into consideration with the following specifications and drawings.

DETAILED DESCRIPTION OF THE DRAWINGS

Figure 2:
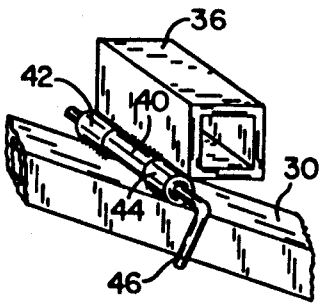
FIG. 2, is a perspective view of a hinge member in its preferred embodiment.
Figure 1:
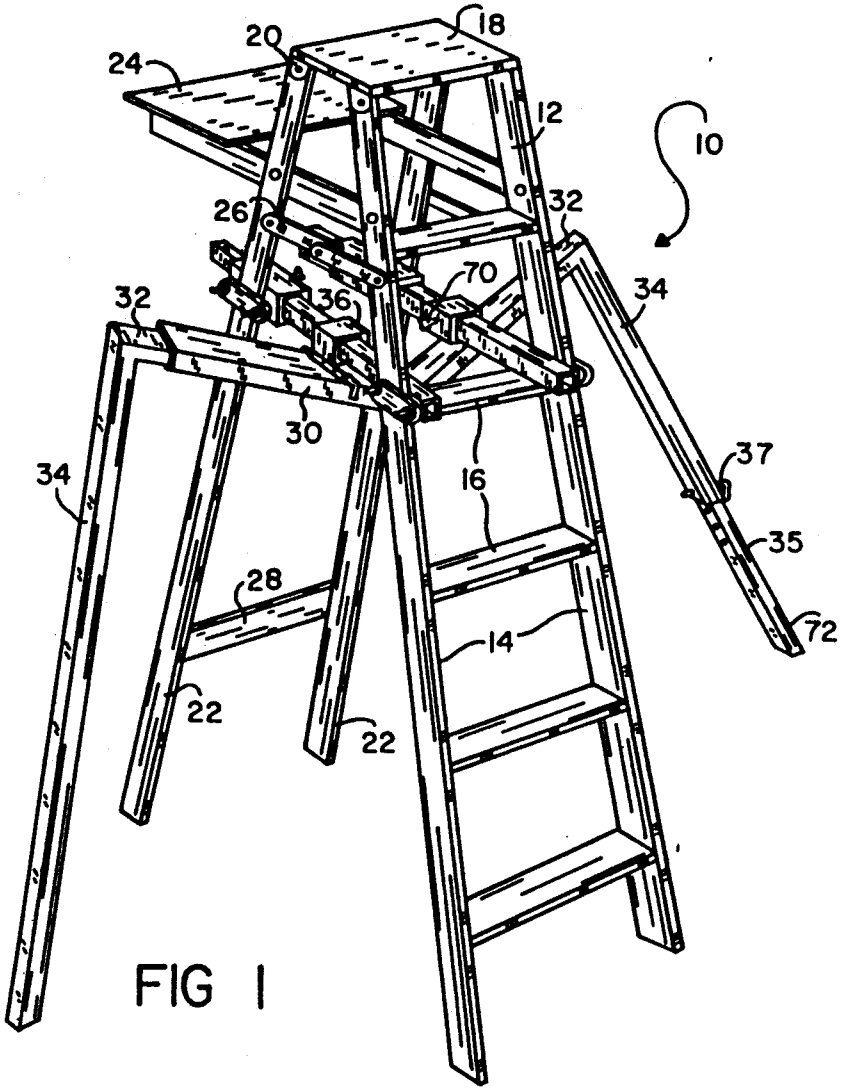
FIG. 1, is a perspective view of the ladder stabilizer.

Referring now in detail to the drawings wherein like characters refer to like elements throughout the various drawings, 10 is an overview of the apparatus attached to a typical prior art step-ladder 12 having a pair of front legs 14 and multiple steps 16 with a top platform 18 and pivotable attachment means 20 to attach the platform to the back legs 22 and front legs 14 of the ladder 12. 24 is a collapsible shelf with 26 being collapsible braces and 28 being a cross brace support between the back legs 22.

Figure 5:
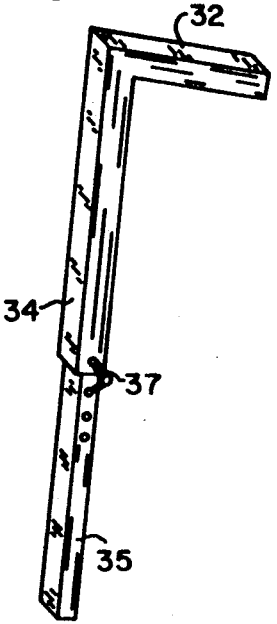
FIG. 5, is a perspective view showing a telescopic leg.
Figure 3:
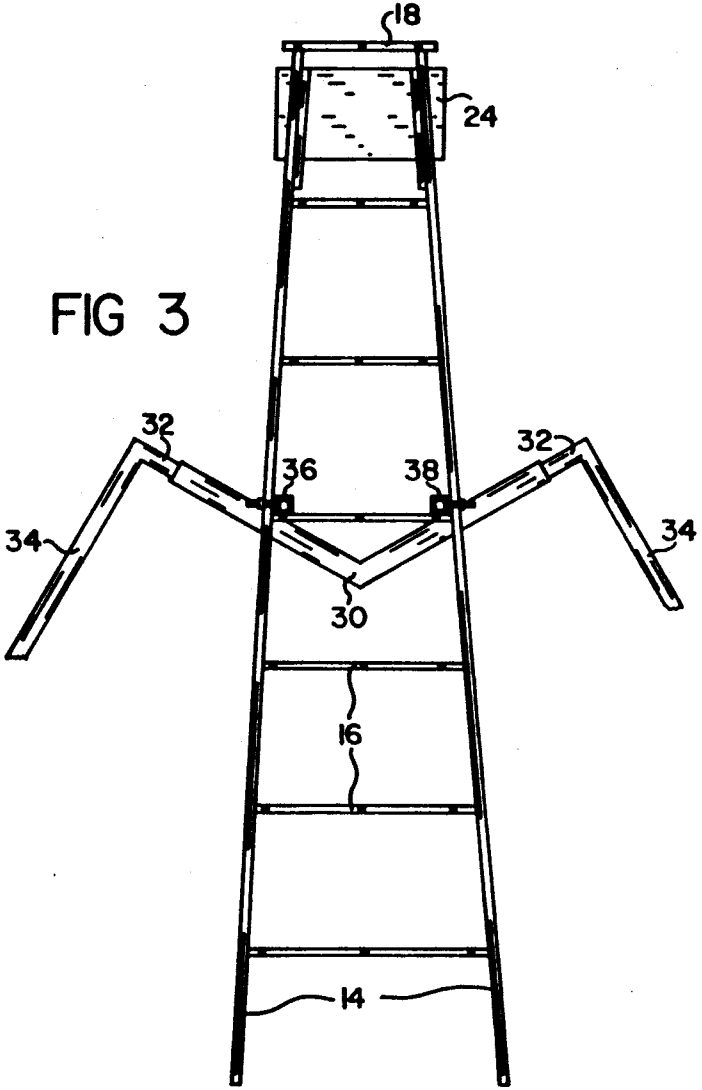
FIG. 3, is a partial frontal view in elevation of the stabilizer in place on a typical ladder.
Figure 4:
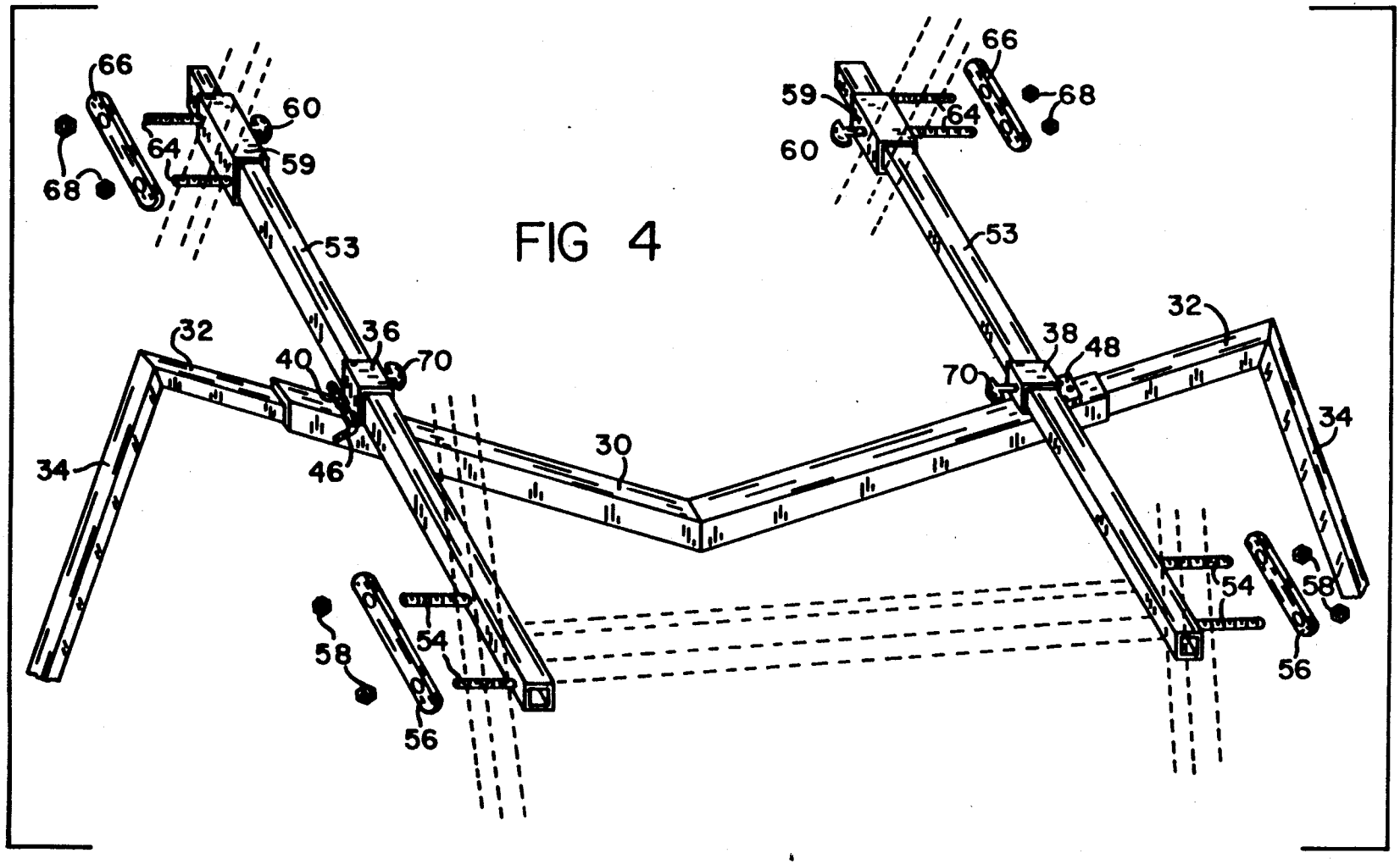
FIG. 4, is a perspective view of the stabilizer with the ladder shown by ghost lines.

Referring now to FIG. 4, 30 is a V-shaped cross member made of substantially square metal tubing of a size and shape to except in a sliding relationship the short leg 32 of a pair of L-shaped support legs 34, which may have telescoping legs 35 more clearly shown in FIG. 5, secured by pins 37. V-shaped cross member 30 also serves as a base for hinged tubular members 36 and 38, respectively, with 36 being removably affixed to V-shaped member 30 by a hinge 40 and mating hinge elements 42 and 44, respectively, and removable hinge pin 46, more clearly shown in FIG. 2. A second embodiment of a hinge is shown, hinging element 38 to V-shaped element 30 by a conventional hinge 48 which may be permanently affixed to element 30 and 38, respectively by welding (not shown).

53 is a pair of elongated, substantially square tubular members having attachment means to the front ladder legs 14 such as bolts 54, clamp member 56 and nuts 58, while the distal ends of tubular members 53 are supported by a second pair of tubular members 59 which are of a size and shape to slidably engage tubular members 53, tubular members 59 being removably secured to the back legs 22 of ladder 12 by thumb screws 60 and having attachment means to the back ladder legs 22 such as bolts 64, clamps 66 and nuts 68.

Hinged tubular members 36 and 38, respectfully, are also elongated substantially square tubular members which are of a size and shape to slidably engage tubular members 53 and removably secured to member 53 by thumb screws 70.

METHOD OF ATTACHMENT

After the ladder 12 has been opened to a standing position, one of the elongated tubular members 53 is inserted through the hinged tubular member 30 and is then positioned beneath the ladder between the front legs 14 and the back legs 22 at a location of choice such as the third or forth steps 16 and the bolts 54 straddle the front leg and one of the clamp members 56 is placed over the bolts 54 and nuts 58 affixed loosely in place.

Now one of the tubular members 59 is placed over the distal end of member 53 and bolts 64 straddle the opposing back leg 22 of ladder 12 and one of the clamp members 66 is placed over the bolts 64 with the nuts 68 being loosely affixed.

It is now preferable to substantially level the assembly until the member 53 is in a substantially horizontal position between the front and back legs 14 and 22, respectively, and the nuts 58 and 68 tightened and then wing nut 60 may be tightened to secure the member 59 to the leg 22.

Now the second elongated tubular member 53 is attached to the front and back legs 14 and 22, respectively, in a similar manner and the V-shaped member 30 is now raised until hinge member 40 engages mating hinge members 42 and 44, respectively, at which time wing nuts 70 are tightened and the short legs 32 of the L-shaped legs 34 are inserted into the ends of the V-shaped member 30 in a sliding relationship and when the telescopic legs 35 are secured, the short legs 32 will fall inward until the bottom ends of the telescopic legs 35 engage a supporting surface. The legs 34 are free floating and independent of each other and when the ladder 12 is rocked in a lateral motion will take up any slack, thus are self-adjusting.

It will now be seen that we have provided a ladder stabilizer which may be removably attached to a stepladder by simple hardware such as nuts.

It will also be noted that we have provided a stabilize which requires no modification of the ladder.

It will further be noted that we have provided a stabilizer that is self-adjusting and may be fabricated from stock material such as square tubular stock and welded together where necessary and requires no special tooling.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by Letters Patent is;

1. In combination with a portable ladder having a pair of first and second rails, said first rails having steps, an improvement for stabilizing said ladder wherein the improvement comprises; at least two elongated substantially square tubular first members having a first and second end and a center section, means to releasably attach said first end of said first members to said first rails having steps, means to removably attach said second ends of said first members to said second rails, a V-shaped elongated substantially square tubular second member, at least two elongated substantially square tubular third members, said third members being of a size and shape to slidably engage the outer perimeters of said first members, means to pivotably attach said third members traversely to said V-shaped second member, at least two L-shaped elongated substantially square tubular forth members having first and second sections, said first section being of a size and shape to slidably engage and have a working relationship with the inner surfaces at the outer open ends of said V-shaped second members, said second section of said L-shaped forth members being of a length to substantially reach the supporting surface of said ladder whereby when said improvement for said ladder is attached and secured to said ladder, said L-shaped members fall inward toward each other within the V-shaped second member when said ladder is rocked in a lateral motion until said ladder can no longer be rocked, thus stabilizing said ladder.

2. The improvement for stabilizing said ladder of claim 1 in which said means to releaseably attach said first end of said first members to said first rails having steps are at least two bolts attached at one of their ends to one side of said first end of said first member, a clamp member, said clamp member having mating holes to slidably engage said bolts, said bolts being located far enough apart from each other to pass the inner and outer edges of said first rails, said clamp member being secured against said first rails by threaded nuts.

3. The improvement for stabilizing said ladder of claim 1 in which said means to removably attach said second ends of said first members to said second rails are at least two elongated substantially square tubular fifth members, said fifth members being of a size and shape to slidably engage the outer perimeters of said first members, said fifth members having at least two bolts attached at one of their ends to one side of said fifth members, a clamp member, said clamp member having mating holes to slidably engage said bolts, said bolts being located far enough apart from each other to pass the inner and outer edges of said second rails said clamp members being secured against said second rails by threaded nuts.

4. The improvement for stabilizing said ladder of claim 3 including securing means to secure said fifth members to said first members.

5. The improvement for stabilizing said ladder of claim 4 in which said securing means to secure said fifth member to said first members is a thumb screw.

6. The improvement for stabilizing said ladder of claim 1 in which said means to pivotably attach said third members traversely to said V-shaped second member is a hinge.

7. The improvement for stabilizing said ladder of claim 1 including means to secure said third members to said first members.

8. The improvement for stabilizing said ladder of claim 7 in which said means to secure said third members to said first members are thumb screws.

9. The improvement for stabilizing said ladder of claim 1 in which said third members are secured at substantially said center sections of said first members.

10. The improvement for stabilizing said ladder of claim 1 in which said L-shaped forth members include a third section, said third section having a telescopic relationship with said second sections and locking means to lock said third sections to said second sections in multiple positions.

11. The improvement for stabilizing said ladder of claim 10 in which said locking means is a pin and multiple matching holes in said second and third sections.

* * * * *